US009780485B2

(12) United States Patent
Troquet et al.

(10) Patent No.: US 9,780,485 B2
(45) Date of Patent: Oct. 3, 2017

(54) BAYONET TYPE LOCKING RING OF A CIRCULAR ELECTRICAL CONNECTOR

(71) Applicant: SOURIAU, Versailles (FR)

(72) Inventors: Gilles Troquet, Le Mans (FR); Julien Feurprier, Saint Mars la Briere (FR)

(73) Assignee: SOURIAU, Versailles (FR)

( * ) Notice: Subject to any disclaimer, the term of this patent is extended or adjusted under 35 U.S.C. 154(b) by 0 days.

(21) Appl. No.: 15/170,181

(22) Filed: Jun. 1, 2016

(65) Prior Publication Data

US 2016/0352044 A1 Dec. 1, 2016

(51) Int. Cl.

| | |
|---|---|
| ***H01R 13/62*** | (2006.01) |
| ***H01R 13/625*** | (2006.01) |
| ***H01R 13/508*** | (2006.01) |
| *H01R 13/506* | (2006.01) |

(52) U.S. Cl.
CPC ..... *H01R 13/625* (2013.01); *H01R 13/508* (2013.01); *H01R 13/506* (2013.01)

(58) Field of Classification Search
CPC ..... H01R 13/62933; H01R 13/623; H01R 13/622
USPC ..... 439/310–321, 332
See application file for complete search history.

(56) References Cited

U.S. PATENT DOCUMENTS 3,551,880 A * 12/1970 Hartwell ..... H01R 13/625 439/314
3,945,703 A * 3/1976 McCormick ..... H01R 13/71 439/311
4,066,315 A * 1/1978 Arneson ..... H01R 13/622 439/311
4,230,390 A * 10/1980 Wells ..... H01R 13/623 285/353
4,239,314 A * 12/1980 Anderson ..... H01R 13/622 285/82
4,277,125 A * 7/1981 Ball ..... H01R 13/622 439/311
4,284,313 A * 8/1981 Anhalt ..... H01R 13/6271 285/260
4,477,022 A * 10/1984 Shuey ..... H01R 13/422 439/314
4,477,140 A * 10/1984 Espiritu ..... H01R 13/622 439/312
4,519,661 A * 5/1985 Brush, Sr. ..... H01R 13/622 439/312
4,820,185 A * 4/1989 Moulin ..... H01R 13/621 385/59

(Continued)

*Primary Examiner* — Thanh Tam Le
(74) *Attorney, Agent, or Firm* — Im IP Law; C. Andrew Im

(57) ABSTRACT

A bayonet type locking ring of a circular electrical connector. A first piece with the shape of a cylindrical ring extends from one end to the other. The first piece is made of thermoplastic material, and includes notches distributed over the internal face of the first piece adjacent to one end and a first ramp part on the internal face of the first piece. A second piece with the shape of a cylindrical ring, and includes notches distributed over its external face and a second ramp part on the internal cylindrical surface. The first piece and the second piece are assemblable such that the notches of the second piece fit in the notches of the first piece, and prevent the second piece from rotating in relation to the first piece. The second ramp part of the second piece complements the first ramp part of the first piece.

20 Claims, 5 Drawing Sheets

(56) References Cited

U.S. PATENT DOCUMENTS

| | | | | | |
|---|---|---|---|---|---|
| 5,141,448 | A * | 8/1992 | Mattingly | H01R 13/622 | 439/314 |
| 5,256,077 | A * | 10/1993 | Mattingly | H01R 13/625 | 285/396 |
| 5,490,790 | A * | 2/1996 | Okada | H01R 13/4538 | 439/141 |
| 5,662,488 | A * | 9/1997 | Alden | H01R 13/625 | 439/314 |
| 7,553,177 | B2 * | 6/2009 | Antonini | H01R 13/641 | 439/314 |

* cited by examiner

BAYONET TYPE LOCKING RING OF A CIRCULAR ELECTRICAL CONNECTOR

RELATED APPLICATIONS

This application claims priority from French Patent Application No. 15 54925 filed Jun. 1, 2015, which is incorporated herein by reference in its entirety.

TECHNICAL FIELD OF THE INVENTION

This invention relates to a locking ring. In particular, it applies to a bayonet type locking ring of a circular electrical connector, which happens to be the most complex to produce.

BACKGROUND OF THE INVENTION

All bayonet locking rings are of the single-piece type, meaning that they are either molded or machined in a single piece.

In both cases, the resources required are complex and costly, because the ramps of the locking system need to be made inside the piece, and are thus in a back-draft position.

FIG. 1 illustrates the case of a molding 20 with ramps 21. The mold must have a collapsible core in order to unmold the ramps.

The complexity of the mold makes it impossible or difficult to mold an optimized piece due to constraints relating to injection, the low mass in some locations and constant thicknesses.

FIGS. 2 and 3 show a locking ring machined in brass. The ramps cut in the inner diameter of the ring must be made with machining equipment (combination of movements, therefore cams or numerical control) and tool holders (angle transmission). The zones 22 show the specific shapes to be made from the inside. These operations are complex and expensive and can generate scrap.

OBJECT OF THE INVENTION

The invention aims to remedy those drawbacks.

To that end, the invention relates to a bayonet type locking ring of a circular electrical connector, characterized in that it comprises:

- a first piece with the shape of a cylindrical ring extending from one end to the other, wherein said first piece comprises notches distributed over the internal face of the first piece adjacent to one end and a first ramp part on the internal face of the first piece, wherein the first piece is made of thermoplastic material,
- a second piece with the shape of a cylindrical ring, wherein said second piece comprises notches distributed over its external face and a second ramp part on the internal cylindrical surface and when the first and second pieces are assembled:
  - the notches of the second piece fit in the notches of the first piece and prevent the second piece from rotating in relation to the first piece, and
  - the second ramp part of the second piece complements the first ramp part of the first piece.

A ramp has a width that allows a pin of the electrical connector to be moved and guided for locking.

The locking ring is made of two pieces, and the parting surface is located between the two locking ramp parts. The functional shapes of these two parts can thus be made easily regardless of the embodiment selected, with no need for tools or complex methods. Assembly is very simple and fast, and therefore economical.

The two pieces can be molded in very simple tools, since there is no back draft on the pieces.

Thanks to these arrangements, the means of implementation used are inexpensive.

The molding tools are simpler, and so the design of the pieces can be optimized (constant thickness, position of injection points etc.).

In one embodiment, the second piece clips into the first piece, thus preventing the displacement of the first piece in relation to the second piece.

In one embodiment, the second piece clips into the first piece up to a stop adapted to line up the end of the first piece with the end of the second piece.

In one embodiment, the second piece (24) is denser than the first piece.

The material of each piece is selected and adapted as needed, for a low cost.

In one embodiment, the second piece is in metal, such as molded Zamak, or in very high performance thermoplastic material.

In a very general manner, a thermoplastic material means in this document any material comprising a certain percentage of thermoplastic material making up a matrix, whether the material is made only of thermoplastic material or is for example a composite material with continuous fibers and a thermoplastic matrix.

In this document, a very high performance thermoplastic material is any material that offers high strength, high rigidity and excellent resistance to hydrolysis, all of them over a wide range of temperatures, making it suitable for applications even under extreme stresses. The very high performance thermoplastic material is particularly selected from the family of PAEK (for polyaryletherketone) plastics: polyetheretherketone (known as PEEK), polyetherketoneketone (known as PEKK) or a combination of two of them.

In another alternative, the very high performance thermoplastic material is particularly selected from polyphenylene sulfide (known as PPS), polyamide-imide (known as PAI), polyethersulfone (known as PES), polyetherimide (known as PEI), liquid crystal polymer (known as LCP) or a combination of at least two of them.

Regarding the second piece, it is reduced to the strict minimum. The choice of material is related to the use of the connector. Thus, to improve the lifespan of the connector, the second piece is in metal, which makes it more friction resistant. To reduce its weight, the second piece is in very high performance thermoplastic. Thus, the surface is protected, and in that case, the second piece avoids corrosion risks.

In one embodiment, the first piece has a U, V or W shaped groove portion on its external cylindrical surface, adapted for grasping the first piece in the hand. Thus, the locking ring is easier to grasp in one hand for manual locking. This alternative is more ergonomic (shape better adapted to the hand).

BRIEF DESCRIPTION OF FIGURES

Other benefits, aims and characteristics of the invention will become apparent in the description below, which is explanatory and not limitative in any way, by reference to the drawings attached, wherein.

DESCRIPTION OF EXEMPLARY EMBODIMENTS OF THE INVENTION

Figure 1:
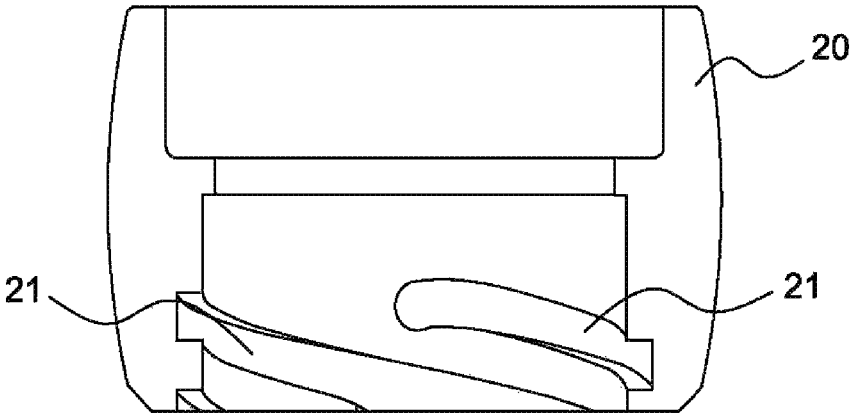
Fig.1 Prior art
FIG. 1 (relating to the prior art) represents a section of a molded piece.
Figure 2:
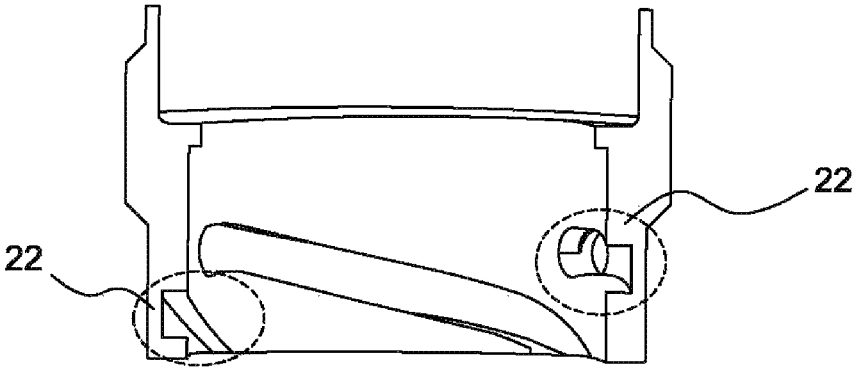
Fig.2 Prior art
FIGS. 2 and 3 (relating to the prior art) represent sections of a machine piece.
Figure 3:
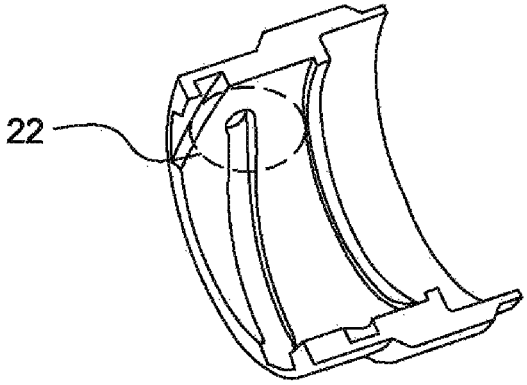
Prior art Fig.3

FIGS. 1 to 3 have been described above.

Figure 4:
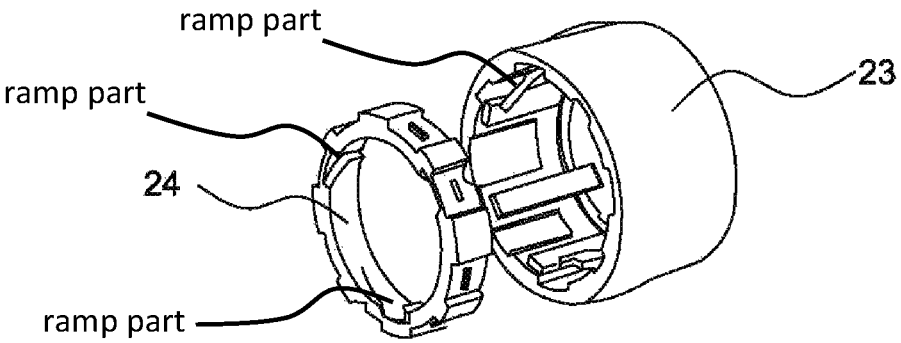
FIG. 4 represents an exploded view before assembly of the first piece with the second piece of a locking ring according to this invention.

FIG. 4 shows the first piece 23 and the second piece 24 before they are assembled. The first piece 23 comprises notches distributed over the entire circumference of the internal surface. The second piece 24 comprises notches distributed over the entire circumference of the external surface. The notches of the first piece 23 and the notches of the second piece 24 are complementary.

Figure 5:
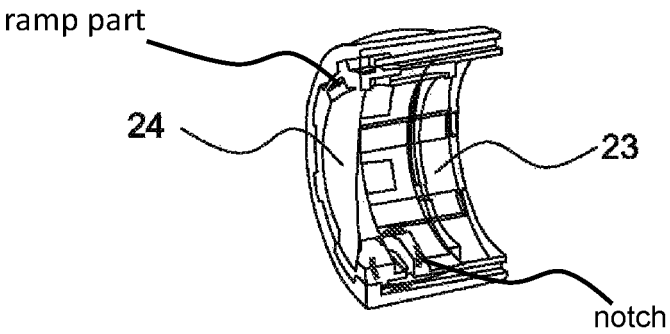
FIG. 5 represents a sectional view along a transverse plane of a locking ring according to this invention.

FIG. 5 shows the assembly of the first piece 23 and the second piece 24. When these two pieces are assembled by displacement in the longitudinal direction of the first piece 23, the second piece 24 can no longer rotate in relation to the first piece 23. The notches make it possible to prevent such rotation.

Figure 6:
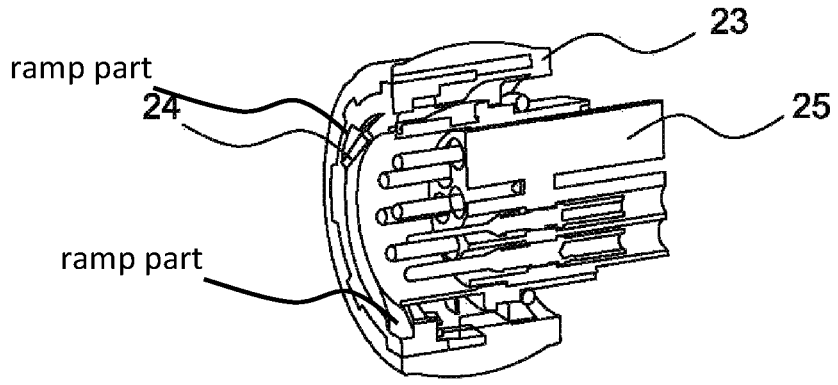
FIG. 6 represents a sectional view of a locking ring according to this invention with an electrical connector.
Figure 7:
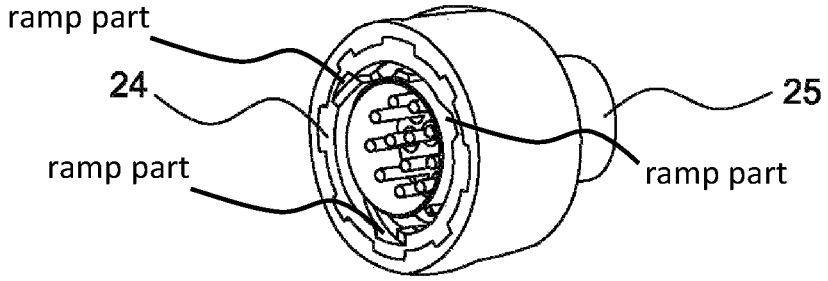
FIG. 7 represents a view of a locking ring according to this invention with an electrical connector.
Figure 8:
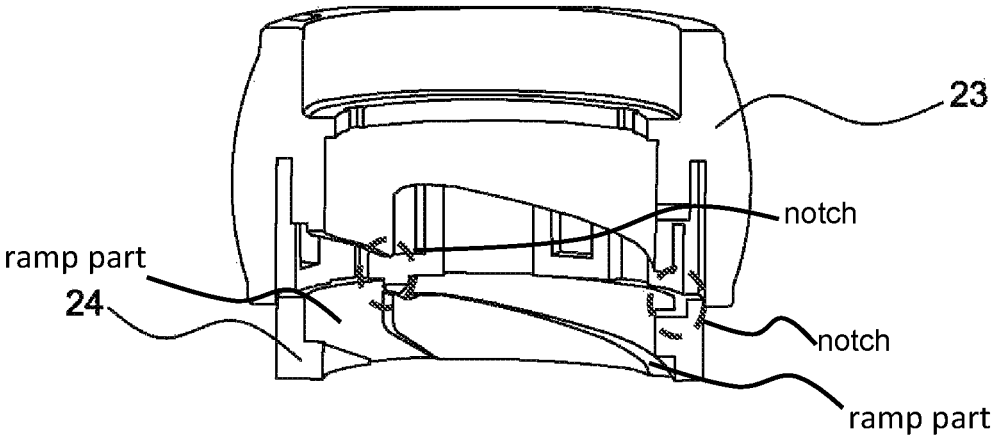
FIG. 8 represents a sectional view along a transverse plane before assembly of the first piece with the second piece of a locking ring according to this invention.

FIGS. 6 and 7 show the positioning of an electrical connector 25 in the locking ring. The first piece 23 and the second piece 24 are assembled before the electrical connector is positioned.

FIGS. 8 and 11-13 represent a sectional view of the first piece 23 and the second piece 24 before they are assembled. In these figures, the first ramp part of the first piece 23 is visible, as is the second ramp part of the second piece 24.

Figure 11:
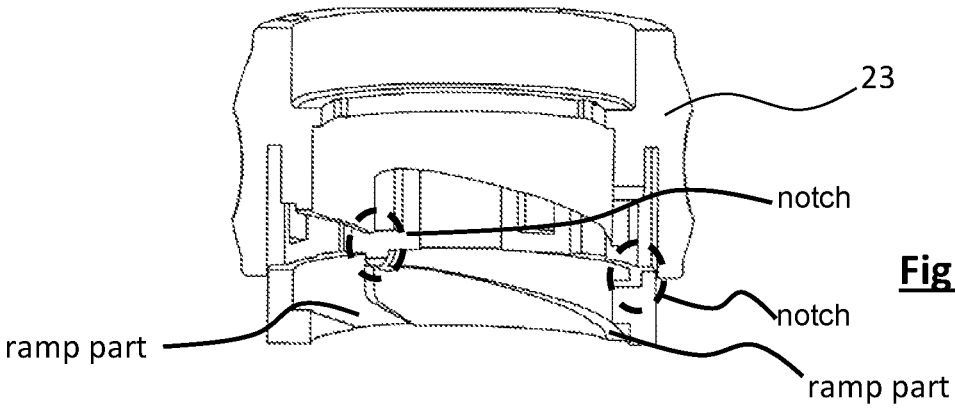
FIG. 11 represents a sectional view along a transverse plane before assembly of the first piece with the second piece of a locking ring according an embodiment of this invention with a U shaped groove portion.
Figure 12:
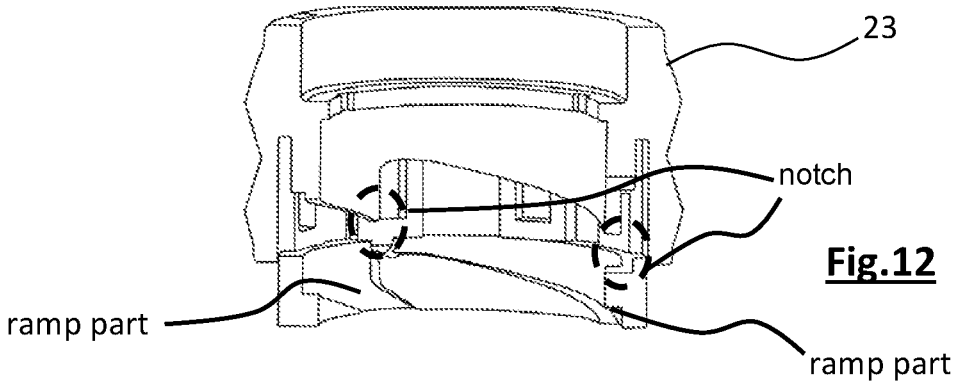
FIG. 12 represents a sectional view along a transverse plane before assembly of the first piece with the second piece of a locking ring according an embodiment of this invention with a V shaped groove portion.
Figure 13:
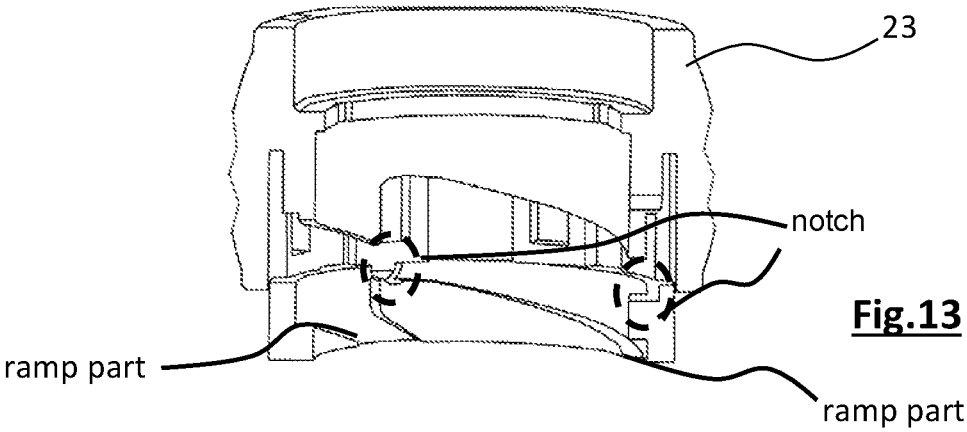
FIG. 13 represents a sectional view along a transverse plane before assembly of the first piece with the second piece of a locking ring according an embodiment of this invention with a W shaped groove portion.

In one embodiment, the first piece has a U, V or W shaped groove portion on its external cylindrical surface, as respectively shown in FIGS. 11-13, adapted for grasping the first piece in the hand. Thus, the locking ring is easier to grasp in one hand for manual locking. This alternative is more ergonomic (shape better adapted to the hand).

Figure 9:
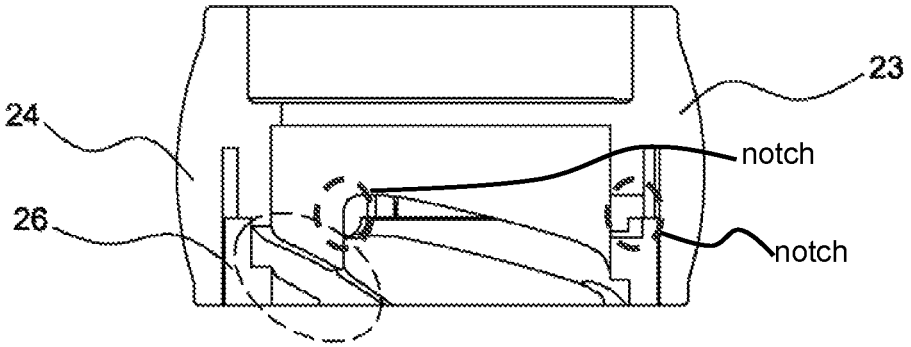
FIG. 9 represents a sectional view along a transverse plane of a locking ring according to one embodiment.

FIG. 9 is a sectional view of the assembly of the first piece 23 and the second piece 24. A zone 26 is represented, which shows the complementarity of the second ramp part with the first ramp part. In that figure, only a first ramp part (sectional view) is visible, but in this embodiment, the first piece 23 has two first ramp parts and the second piece has two second ramp parts.

Each ramp part is designed to receive the pin of an electrical connector to guide the pin towards the end of the ramp, which locks the circular electrical connector. A push and turn movement is required.

Figure 10:
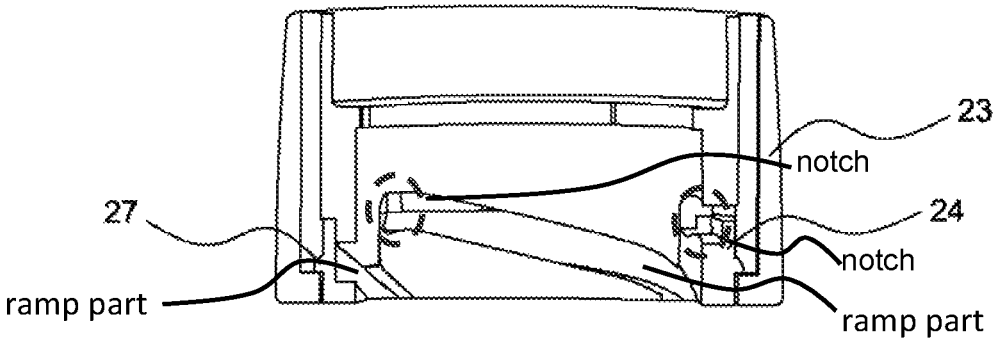
FIG. 10 represents a sectional view along a transverse plane of a locking ring according to another embodiment.

FIG. 10 is a sectional view of the assembly of the first piece 23 and the second piece 24, and shows the alternative with clipping 27.

The two pieces are assembled by clipping in the main direction of the piece (rotation axis), either manually or automatically. Clipping means attaching with a clip.

In this case, the external face of the second piece 24 comprises a pin (clip) that blocks the second piece 24 in relation to the first piece 23. Like the previous figure, the second ramp part complements the first ramp part.

The ramp part responsible for locking (second piece 24) happens to be subjected to the most stress, as it receives the forces for connecting the contacts, and pressing the coupling joint. The second piece 24 is made of metal (cast Zamak), or very high performance thermoplastic.

The part responsible for unlocking (first piece 23), which is thus subjected to the least force (friction of contacts only) is made of more ordinary and less expensive molded thermoplastic material. The material is thus selected depending on the stresses and the required performance.

In another embodiment, the color and marking of the first piece 23 are different.

The invention claimed is:

1. A bayonet type locking ring of a circular electrical connector, comprising:

a first piece with a shape of a cylindrical ring extending from one end to the other, the first piece comprising notches distributed over an internal face of the first piece adjacent to the one end and a first ramp part on the internal face of the first piece, and a U shaped grooved portion on an external cylindrical surface, wherein the first piece is made of thermoplastic material and wherein the notches of the first pieces are distinct from the first ramp part;

a second piece with a shape of a cylindrical ring, the second piece comprising notches distributed over an external face of the second piece and a second ramp part on an internal cylindrical surface of the second piece, wherein the notches of the second piece are distinct from the second ramp part; and when the first piece and the second piece are assemblable such that:

the notches of the second piece fit in the notches of the first piece and prevent the second piece from rotating in relation to the first piece; and the second ramp part of the second piece complements the first ramp part of the first piece.

2. The bayonet type locking ring according to claim 1, wherein the second piece clips into the first piece, thus preventing a displacement of the first piece in relation to the second piece.

3. The bayonet type locking ring according to claim 1, wherein the second piece clips into the first piece up to a stop configured to line up an end of the first piece with an end of the second piece.

4. The bayonet type locking ring according to claim 1, wherein the second piece is denser than the first piece.

5. The bayonet type locking ring according to claim 1, wherein the second piece is made of a metal.

6. The bayonet type locking ring according to claim 5, wherein the second piece is made of a molded Zamak.

7. The bayonet type locking ring according to claim 1, wherein the second piece is made of a thermoplastic material.

8. The bayonet type locking ring according to claim 7, wherein the thermoplastic material is selected from a family of polyaryletherketone (PAEK) plastics: polyetheretherketone (PEEK), polyetherketoneketone (PEKK) or a combination of two of them.

9. The bayonet type locking ring according to claim 7, wherein the thermoplastic material is selected from polyphenylene sulfide (PPS), a polyamide-imide (PAI), polyethersulfone (PES), polyetherimide (PEI), liquid crystal polymer (LCP) or a combination of at least two of them.

10. A bayonet type locking ring of a circular electrical connector, comprising:

a first piece with a shape of a cylindrical ring extending from one end to the other, the first piece comprising notches distributed over an internal face of the first piece adjacent to the one end and a first ramp part on the internal face of the first piece, and a V shaped grooved portion on an external cylindrical surface, wherein the first piece is made of thermoplastic material and wherein the notches of the first pieces are distinct from the first ramp part;

a second piece with a shape of a cylindrical ring, the second piece comprising notches distributed over an external face of the second piece and a second ramp part on an internal cylindrical surface of the second piece, wherein the notches of the second piece are distinct from the second ramp part; and when the first piece and the second piece are assemblable such that:

the notches of the second piece fit in the notches of the first piece and prevent the second piece from rotating in relation to the first piece; and the second ramp part of the second piece complements the first ramp part of the first piece.

11. The bayonet type locking ring according to claim 10, wherein the second piece clips into the first piece to prevent a displacement of the first piece in relation to the second piece.

12. The bayonet type locking ring according to claim 10, wherein the second piece clips into the first piece up to a stop configured to line up an end of the first piece with an end of the second piece.

13. The bayonet type locking ring according to claim 10, wherein the second piece is made of a metal, a molded Zamak or a thermoplastic material.

14. The bayonet type locking ring according to claim 13, wherein the thermoplastic material is selected from a family of polyaryletherketone (PAEK) plastics: polyetheretherketone (PEEK), polyetherketoneketone (PEKK) or a combination of two of them.

15. The bayonet type locking ring according to claim 13, wherein the thermoplastic material is selected from polyphenylene sulfide (PPS), polyamide-imide (PAI), polyethersulfone (PES), polyetherimide (PEI), liquid crystal polymer (LCP) or a combination of at least two of them.

16. A bayonet type locking ring of a circular electrical connector, comprising:

a first piece with a shape of a cylindrical ring extending from one end to the other, the first piece comprising notches distributed over an internal face of the first piece adjacent to the one end and a first ramp part on the internal face of the first piece, and a W shaped grooved portion on an external cylindrical surface, wherein the first piece is made of thermoplastic material and wherein the notches of the first pieces are distinct from the first ramp part;

a second piece with a shape of a cylindrical ring, the second piece comprising notches distributed over an external face of the second piece and a second ramp part on an internal cylindrical surface of the second piece, wherein the notches of the second piece are distinct from the second ramp part; and when the first piece and the second piece are assemblable such that:

the notches of the second piece fit in the notches of the first piece and prevent the second piece from rotating in relation to the first piece; and the second ramp part of the second piece complements the first ramp part of the first piece.

17. The bayonet type locking ring according to claim 16, wherein the second piece clips into the first piece to prevent a displacement of the first piece in relation to the second piece.

18. The bayonet type locking ring according to claim 16, wherein the second piece clips into the first piece up to a stop configured to line up an end of the first piece with an end of the second piece.

19. The bayonet type locking ring according to claim 16, wherein the second piece is made of a metal, a molded Zamak or a thermoplastic material.

20. The bayonet type locking ring according to claim 19, wherein the thermoplastic material is selected from polyphenylene sulfide (PPS), polyamide-imide (PAI), polyethersulfone (PES), polyetherimide (PEI), liquid crystal polymer (LCP), a combination of at least two of PPS, PAI, PES, PEI and LCP, a family of polyaryletherketone (PAEK) plastics: polyetheretherketone (PEEK), polyetherketoneketone (PEKK) or a combination of two of the PAEK plastics.

* * * * *